United States Patent [19]

Mark

[11] Patent Number: 5,065,832

[45] Date of Patent: Nov. 19, 1991

[54] MULTIPLE SECTION WORK STATION

[75] Inventor: Edward H. Mark, South Bend, Ind.

[73] Assignee: Packard Industries, Inc., Niles, Mich.

[21] Appl. No.: 115,818

[22] Filed: Nov. 2, 1987

[51] Int. Cl.[5] ..... A47B 57/00

[52] U.S. Cl. ..... 108/60; 108/50

[58] Field of Search ..... 108/60, 66, 50, 94, 108/95, 106, 107

[56] References Cited

U.S. PATENT DOCUMENTS

| | | | |
|---|---|---|---|
| 2,476,535 | 7/1949 | Denson et al. | 108/60 X |
| 2,970,874 | 2/1961 | Honeycutt et al. | 108/60 X |
| 3,538,863 | 11/1970 | Howard et al. | 108/94 |
| 3,592,345 | 7/1971 | Featherman | 108/107 X |
| 3,685,664 | 8/1972 | Kramer | 108/60 X |
| 3,698,104 | 10/1972 | Sutton | 108/60 X |
| 3,986,461 | 10/1976 | Steele | 108/60 |
| 4,370,727 | 4/1983 | Doss | 108/60 X |
| 4,426,010 | 1/1984 | LeMer | 108/94 X |
| 4,500,150 | 2/1985 | Leibensperger et al. | 108/50 X |
| 4,706,572 | 11/1987 | Preisemuth | 108/60 |

*Primary Examiner*—Jose V. Chen

*Attorney, Agent, or Firm*—Thomas J. Dodd

[57] ABSTRACT

A work station which includes a central core member and multiple partition walls detachably fastened thereto for defining several separated work stations. The core member may include all electrical wirings and a fresh air circulation blower as well as other useful items for today's modern office worker.

6 Claims, 4 Drawing Sheets

MULTIPLE SECTION WORK STATION

SUMMARY OF THE INVENTION

This invention relates to multiple sectional work stations.

Increasing costs and availability of office work space is of prime concern in business today. Movable partitions are now in widespread use to create multiple work stations and promote efficient use of workable office space. However, partitions are often expensive, bulky and often prove difficult to install and tear down.

The work station of this invention includes multiple partition walls detachably connected to a central core member to form a plurality of work stations about the core. The core also houses the electrical wiring necessary to run the electrical equipment used at the work station, and further houses fresh air circulation components for the individual stations. This construction allows for maximum efficient use of work space and also provides greater work area space for the individual workers.

Accordingly, it is an object of this invention to provide for a novel multiple section work station.

Another object of this invention is to provide for a multiple section work station which provides greater individual work area in a smaller overall space.

Another object of this invention is to provide a multiple section work station which is positioned about a central core which houses the electrical and phone wiring and further houses an air circulation system.

Another object of this invention is to provide for a multiple section work station which is easily and quickly assembled and disassembled, and may also be converted into a two, three, four, five, or six section work station with relative ease.

Other objects of this invention will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

The preferred embodiment herein described is not intended to be exhaustive or to limit the invention to the precise form disclosed. It is chosen and described to explain the principles of the invention, and its application and practical use to enable others skilled in the art to utilize the invention.

Figure 1:
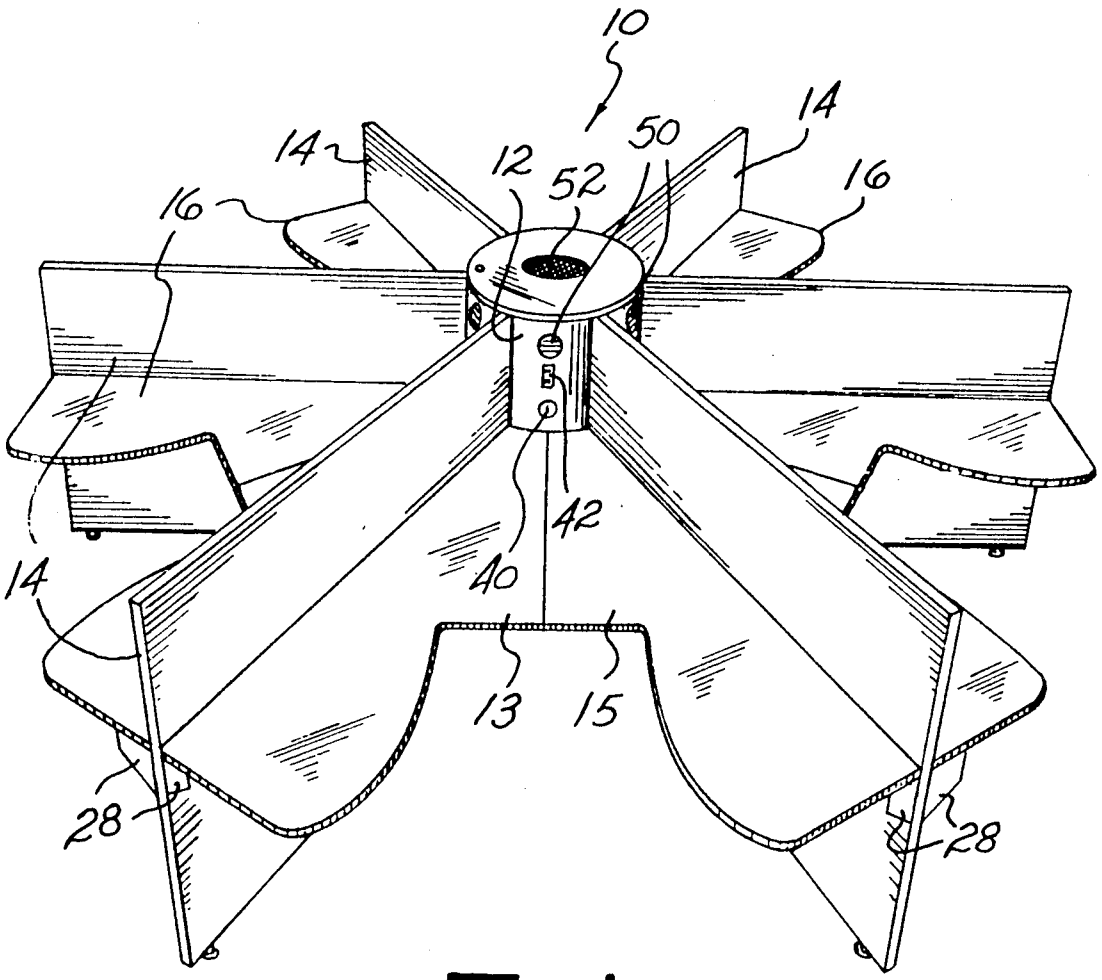
FIG. 1 is a perspective view of a multiple section work station according to the teachings of this invention illustrating a six section work station.

Referring now to the drawings, reference numeral 10 refers generally to the multiple section work station of this invention. Work station 10 is shown as a six station unit in FIG. 1, but may be modified to house any number of stations, generally from two on up depending upon individual needs. Work station 10 includes generally a core member 12, partition walls 14 and desk tops 16.

Figure 2:
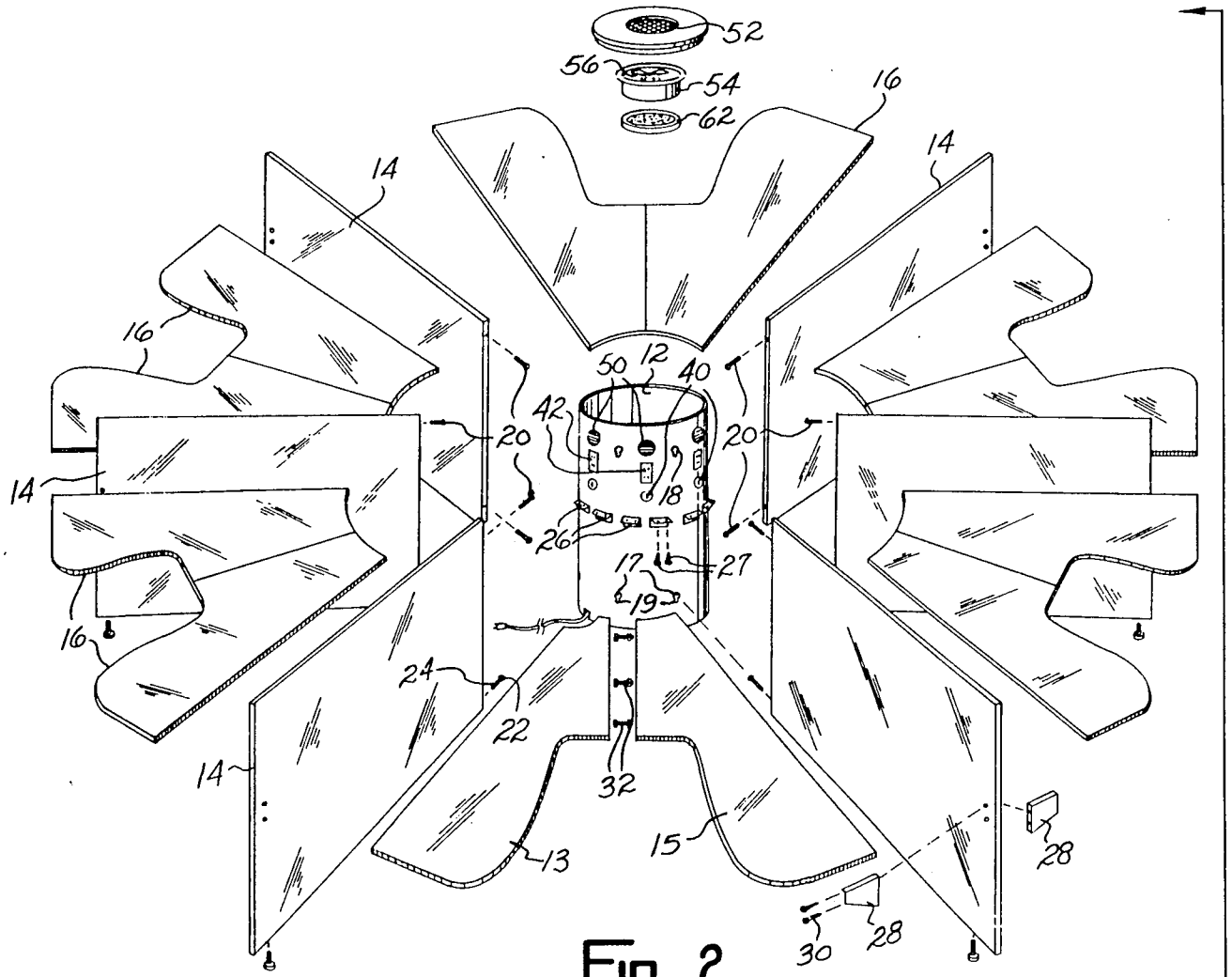
FIG. 2 is an exploded view of the work station of FIG. 1.
Figure 3:
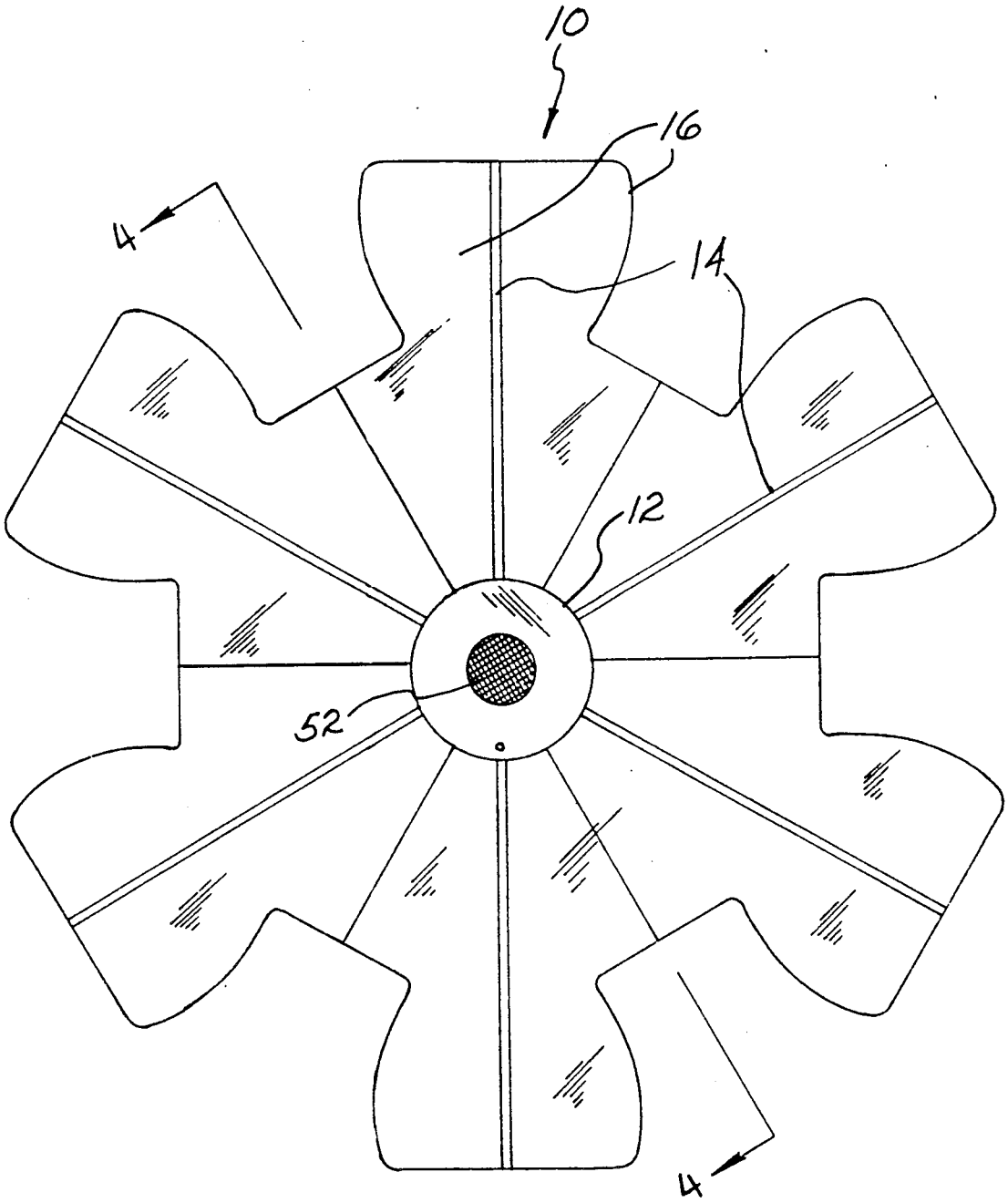
FIG. 3 is a top plan view of the work station.
Figure 4:
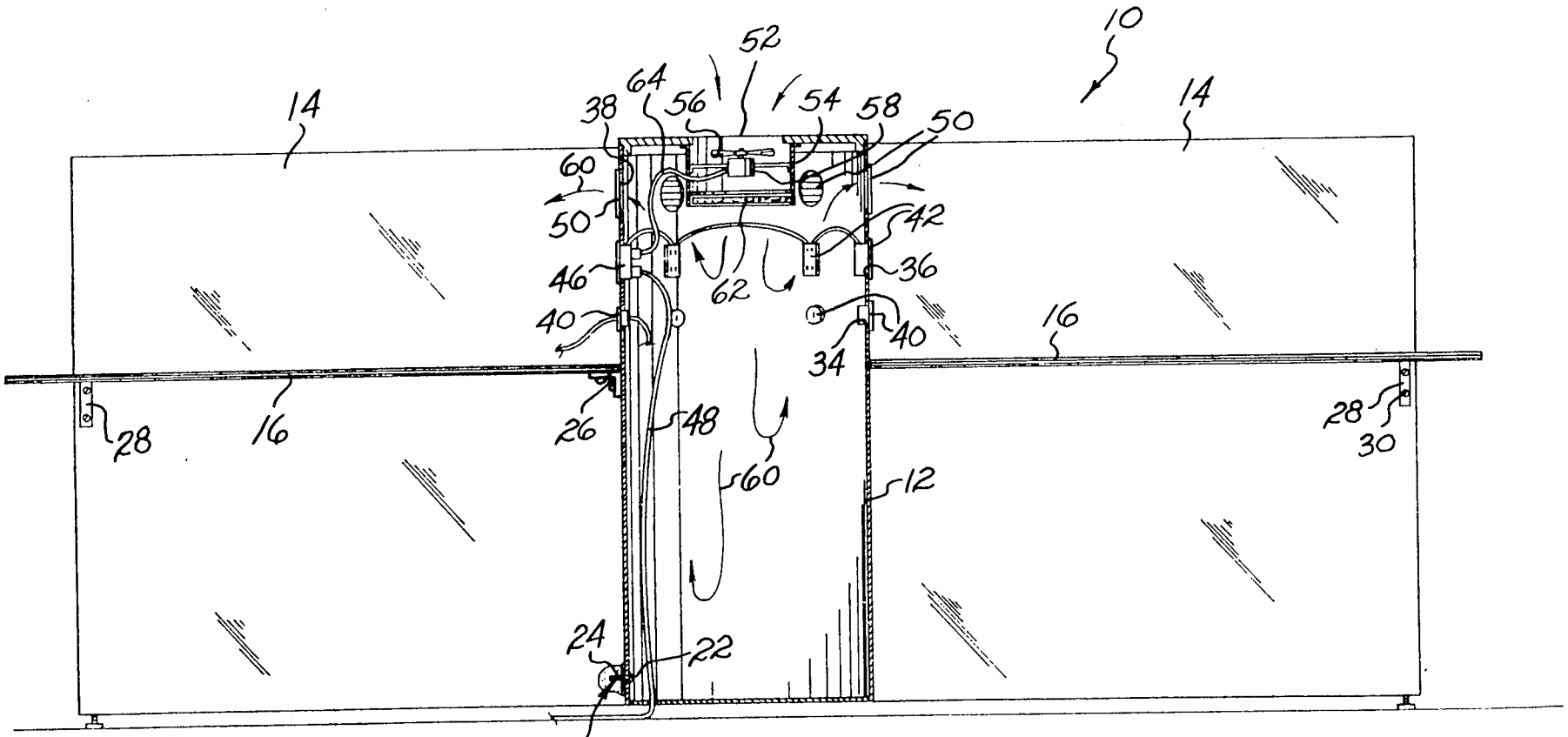
FIG. 4 is a sectional view taken along line 4—4 of FIG. 3.

Core member 12 as shown in FIGS. 2 and 4 may be of the generally cylindrical shape shown and defines a plurality of spaced keyholes 18 which are preferably of the shape shown in FIG. 2. Fasteners are provided such as screws 20, each including a head 22 and a shank 24, with the shank extending into partition walls 14 to expose the head. Each partition wall 14 preferably includes two or more such screws 20 spaced apart as shown and aligned with respective keyholes 18. Walls 14 are selectively arranged by detachable securement to core 12 through screws 20 by inserting heads 22 into the enlarged portion 17 of each keyhole 18 and allowing the shank 24 to slide downward into keyhole slot 19 which is of smaller dimensions than the heads to secure the walls to the core.

A plurality of brackets 26 may be secured to core 12 as shown in FIG. 2 by appropriate fasteners 27. Brackets 28 are secured to partition walls 14 at the outer periphery thereof by fasteners 30. Desk tops 16 may be of one piece construction or of a two piece construction with desk parts 13,15 secured by appropriate fasteners 32. Tops 16 are fitted between partition walls 14 and are supported upon brackets 26,28. Desk tops 16 may also be secured to partition walls 14 by horizontal fasteners (not shown).

Core 12 also defines a plurality of holes 34.36,38 at each work station above each desk top 16. Hole 34 houses a grommet 40 through which a computer and/or telephone cable may extend from inside core 12 to a particular work station. Hole 36 houses an electrical outlet 42 which is connected by cord 44 to a central control outlet 46 which in turn is connected to a power source (not shown) by cable 48 which extends downwardly of core 12 and outwardly below walls 14. Hole 38 houses an air outlet control louver unit 50 which may be adjusted to control air flow rate to the work station.

Core 12 is preferably of the hollow nature shown in FIG. 4 and is covered at its top by a screen 52. A blower or fan 54 is connected to screen 52 and is concealed inside core 12. Fan 54 includes vanes 56 which rotate upon actuation of motor 58 and draw air into core 12 through air filter 62 as shown by arrows 60. When the interior of core 12 fills with air, the filtered air is forced through hole 38 and louvered unit 50, thereby circulating fresh air to the work stations as desired. Fan 54 is connected electrically to control 46 by cord 64.

It is understood that the construction above indentified does not limit the invention to those precise details. It may be modified to suit individual needs dependant upon amount and type of stations required by varying the position of the keyholes 18 and adding or subtracting outlets 42, louver units 50 and/or grommets 40. Additional shelving may also be added for storage, keyboards, etc. as well as drawers or other storage facilities all within the scope of the invention as defined by the following claims.

I claim:

1. In a work station having multiple work sections separated by partition walls, the improvement comprising a central core member, said partition walls detachably fastened to said core member at spaced locations and extending outwardly from the core member to define said work sections, each work section including desk top means for supporting working utensils, and means associated with one of said core member and partition walls for supporting said desk top means above a floor, said core member including an internal fan means for drawing ambient air into the core member, said core member further including vent means positioned adjacent each work section for selectively delivering ambient air to each work section.

2. The work station of claim 1 wherein said core member is generally cylindrical and houses concealed cable means for connecting working utensils to a power supply.

3. The work station of claim 1 wherein said means for supporting includes a first bracket attached to said core member, and a second bracket attached to each partition wall defining an individual work section, said first and second brackets positioned so as to be in abutment with said desk top means to support the same.

4. The work station of claim 1 wherein said core member defines a plurality of vertically spaced keyholes, each keyhole defined by an enlarged bore portion and a narrow and depending elongated slot communicating with the bore portion, each partition wall including removable fasteners aligned with said keyholes, said removable fasteners including an outer exposed head part fittable through said bore but larger than the dimensions of said slot, and a shank part connected to said head part, said shank slidable within said slot to secure the head part within said core member to secure said partition walls thereto.

5. The work station of claim 1 wherein said desk top means includes first and second desk top parts joined by centrally positioned fasteners.

6. The work station of claim 1 wherein said core member further includes a filter means positioned adjacent said internal fan means, said filter means for filtering impurities from ambient air drawn into said core member by the fan means prior to its discharge through said vent means.

* * * * *